US005377364A

United States Patent [19]

Cabrera

[11] Patent Number: 5,377,364

[45] Date of Patent: Jan. 3, 1995

[54] PORTABLE TOILET ASSEMBLY

[76] Inventor: Jorge Cabrera, 74550 Low Matacumbe Key, Fla. 33036

[21] Appl. No.: 54,621

[22] Filed: Apr. 28, 1993

[51] Int. Cl.[6] ..... A47K 11/04

[52] U.S. Cl. ..... 4/483; 4/300.1

[58] Field of Search ..... 4/484, 483, 479, 239, 4/300.1, 444

[56] References Cited

U.S. PATENT DOCUMENTS

| | | | |
|---|---|---|---|
| 427,627 | 5/1890 | Shepherd | 4/483 |
| 459,148 | 9/1891 | Saunders | 4/483 |
| 543,402 | 7/1895 | Poppens | 4/483 |
| 2,214,066 | 9/1940 | Peters | 4/300.1 |
| 4,326,308 | 4/1982 | Silver | 4/444 X |
| 5,090,063 | 2/1992 | Edwards et al. | 4/239 |

FOREIGN PATENT DOCUMENTS

| | | | |
|---|---|---|---|
| 0240405 | 8/1960 | Australia | 4/239 |
| 0023969 | of 1911 | United Kingdom | 4/239 |

*Primary Examiner*—Charles E. Phillips
*Attorney, Agent, or Firm*—Malloy & Malloy

[57] ABSTRACT

This invention relates to a portable toilet structure including an open ended container which may take the form of a large hollow interior plastic bucket or like structure and a seat structure having an undersurface specifically adapted to be removably attached and to lockingly engage the peripheral edge surrounding the open end. Additional embodiments include a movably mounted toilet paper dispenser, a cleansing assembly in the form of a portable bidet type washing facility and a carrying case which is specifically dimensioned and configured to have the cleansing structure stored therein and the toilet paper dispenser as well as the seat structure to facilitate transporting these components of the subject toilet seat assembly.

12 Claims, 3 Drawing Sheets

24
26
28
2
2
49
49
49
50
50
50
48
52
44
42
41
41
46
40
45
51

24
26
30
32
35

PORTABLE TOILET ASSEMBLY

BACKGROUND OF THE INVENTION

1. Field of the Invention

The present invention relates to a portable toilet assembly including a seat structure specifically adapted to have an undersurface configuration which is adapted to engage and rest upon the surrounding peripheral edge of an open ended portable container such that a plastic bag or like structure may be mounted within the hollow interior of the container to facilitate disposal of waste products passed into the interior of the container by an occupant of the toilet seat.

2. Description of the Prior Art

Prior known portable toilets either operate on a flushing system requiring a water supply and frequently include a separate waste holding tank which can be disconnected from the device for subsequent disposal of the waste. Alternately such devices may be less complicated devices which include having plastic or like material waste bags suspended or removably attached to some type of supporting container or be disposed within a hollow interior therein. Such portable toilets are useful when prolonged or when no water supply is available for flushing. Such circumstances may be frequently encountered during emergency situations and are especially adaptable for use on board relatively small marine craft where regular "flushing" toilet facilities are not available. In order to overcome the problems recognized in the prior art and provide an efficient and operable structure, certain patents, as evidenced and described below are representative of prior art attempts to develop such a simplistic, portable, effective toilet assembly.

The Douglas U.S. Pat. No. 5,088,134 discloses a portable toilet device having a disposable water receiving bag disposed within a hallow interior thereof. The device is movable from an open or in use position to a closed or non use position which causes rotation of the waste receiving bag to temporarily close or seal the bag thereby facilitating and making more agreeable the removal of the bag with the waste product therein for separate disposal of the waste product from the structural components of the toilet itself. The Karr U.S. Pat. No. 3,600,719 discloses a portable collapsible type of toilet structure having a bottom section, a body section and a cover section. The body section is open at the top end and bottom and is foldable between an open, operative position and a flat, inoperative or stored position. In its open position, the bottom end of the body may be supported on the bottom with the cover overlying the upper end of the body. In its folded condition, the body may be stored completely within the bottom section and the cover section inserted over the bottom section to provide a flat package.

The Salka U.S. Pat. No. 2,974,321 discloses a collapsible travel commode which is positionable between an operative, open position and a flat, stored position wherein the stored position is furthered structured to include a carrying case for the various components then the travel commode is not in use. The waste is deposited through an open end serving to attach a flexible material container wherein the overall structure is designed to have sufficient structural integrity to support a person in a seated position thereon. The patent to Peters U.S. Pat. No. 3,495,278 discloses a disposable toilet designed to fit over somewhat of a more rigid type container wherein a bag is disposable within the hollow interior of the container. The seat structure surrounds the periphery while not being removably connected thereto but which does include facilities for locking the peripheral edge of the flexible material bag thereto until disposal is warranted.

The Person U.S. Pat. No. 4,807,308 discloses a portable stacking and nesting toilet comprising a small cup member capable of being nested inside a larger cup shaped member, a seat member having a central opening and a resilient ceiling lid. The bottom of each cup has a raised lip which will engage the lip of the other cup and the open top ends of the cups have an angular rim. The seat member has a groove which engages the rim of the larger cup. A water tight bag is placed in the up right larger cup with the open end of the bag folded over its rim. The seat is place on the rim of the larger cup to secure the top of the bag on the cup rim and the toilet is ready for use. After use the seat is removed the bag is disposed and the members are nested into the stored position.

Despite prior art attempts to provide a simplistic toilet or commode structure without requiring the complicated flushing system normally associated therewith, the prior art is still absent an efficient, easy to use and commercially acceptable structure which can be used in a variety of locations or circumstances, particularly but not necessarily limited to use on small marine crafts where normal toilet flushing facilities are not available. In most situations a simple open ended plastic material bucket or like large container is normally available. Using this as a foundation the present invention solves problems along recognized in the prior art by providing components which easily yet removably but securely fit together to form a comfortable toilet or commode structure which is capable of handling waste disposal in a proper and sanitary manner and also wherein the subject invention, that would be described in greater detail hereinafter, is capable of having other more sophisticated components or supplements added thereto such as a toilet paper dispenser and bidet type cleansing device.

SUMMARY OF THE INVENTION

The present invention relates to a portable toilet assembly of the type which does not involve any flushing activity and therefor, does not include any additional supply of flushing liquid or storage tank facilities. To the contrary the present invention includes the use of a hollow container having an enclosed bottom end and a cylindrical side wall extending upwardly therefrom and integrally attached thereto. The side wall terminates in a specifically defined and continuously configured peripheral edge which defines the peripheral boundary of an open upper end oppositely disposed to the closed end. In certain commercial embodiments the container may be specifically made for this concept, the remaining components of this invention, to be described in greater detail hereinafter, are adaptable for use with a conventional well known and commercially available plastic material bucket generally of the five gallon size category. Such buckets do come in standardized sizes and configurations and as such the peripheral edge thereof are fairly consistent.

Associated with the present invention is the provision of a seat structure which will define the toilet seat. The outer or exposed surface of the toilet seat is specifically adapted to allow a person to comfortably sit thereon. The under surface thereof is specifically adapted to be removably attached in overlying relation to the open end of the container. Further, the undersurface of the seat structure includes a continuously formed channel or grove integrally formed therein which substantially duplicates in size and configuration, the peripheral edge surrounding the open end of the container. By virtue of this structural adaptation the peripheral edge effectively fits within the continuous groove or channel and may be removably secured thereto by the provision of locking means.

The locking means includes one or more locking members also mounted preferably within the groove. The one or more locking members have inherent flexibility or resiliency such that they may be moved into and out of locking position relative to a portion of the peripheral edge of the container. Eventually this construction of the seat is effectively attached and locked oil the container but is easily removed therefrom for purposes of storage. Alternately, an edge or side portion of the seat structure to which a locking member is attached may flex outwardly thereby allowing movement of the locking member out of and into locking engagement with a periphery of the container. In actual use the container may include a plastic material disposable bag to be put in the interior of the container so that any waste of deposit therein may be easily removed. The thinness of such a plastic container will not interfere with the locking engagement of the one or more locking members with the peripheral edge as setforth above.

Other features of the present invention include the provision of a paper dispenser which is movably attached by mounting means to the seat structure and therefor is positionable selectively between an operative position and a stored position. The operative position is more specifically defined by substantially outwardly extending linear orientation of the paper dispenser such that a conventional roll of toilet paper may be secured thereto in readily accessible location to one utilizing the seat structure. The stored position is oriented in somewhat of a downwardly extending depending angularly oriented position such that the roll of paper attached thereto is located somewhat beneath and in an out of the way location relative to the seat structure.

Another feature of the present invention is the provision of a cleansing assembly somewhat in the form of a portable bidet type structure which includes a supply of cleansing liquid, which may be water or the like, a pump structure and an applicator. The applicator is disposed at least partially within the hollow interior of the container and beneath the seat structure such that it is in direct contact with the user or one sitting on the seat structure through a central opening in the seat structure as is conventional. A conduit means is provided for establishing fluid communication between the liquid supply and the applicator and served to interconnect the supply and the pump structure as well as the applicator. Activation of the pump structure by manual force exerted thereon serves to drive or force the liquid in the cleansing liquid supply from the supply through the conduit means to the applicator and onto a person sitting on the seat structure, as setforth above.

Yet another feature of the present invention includes a carrying case which will allow the insertion and housing of all the components mentioned above including the paper dispenser and cleansing assembly as well as the seat structure. The container, which as setforth above may be in the form of a five gallon plastic material bucket or like structure, would be carried separately. Alternately, any such bucket may be utilized. All of the above mentioned components need to be carried since such bucket structures are so commonly available. Utilization of the subject portable toilet assembly can occur on relatively small marine crafts where larger more permanently installed toilets having flushing assemblies are not available. Alternately such toilet assemblies may be available such as on camping trips or other locations where toilet facilities are not readily available.

BRIEF DESCRIPTION OF THE DRAWINGS

For a fuller understanding of the present invention, reference is had to the following detailed description taken in connection with the accompanying drawings in which.

Like reference numerals refer to like parts throughout the several views of the drawings.

DETAILED DESCRIPTION OF THE PREFERRED EMBODIMENT

Figure 6:
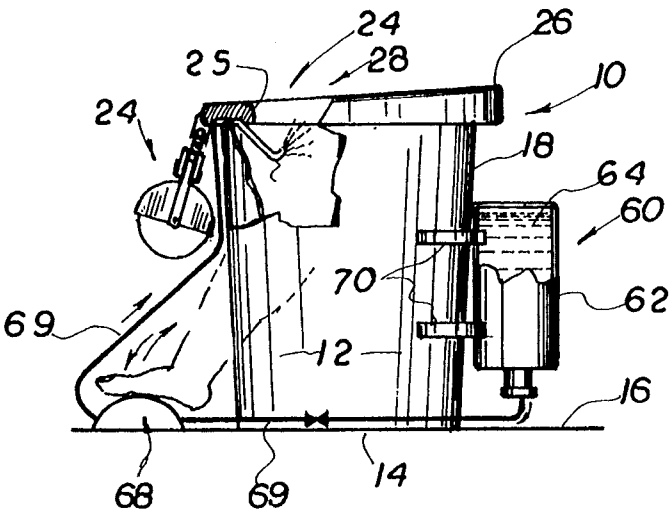
FIG. 6 is a side view of yet another embodiment of the present invention.

The present invention relates to a portable toilet assembly shown in its fully assembled condition in FIG. 6 and generally represented therein as 10. The subject assembly includes a hollow interior container 12 having a closed bottom end as at 14 capable of resting on any type of supporting surface 16. A cylindrical side wall as at 18 is integrally attached to the closed end 14 and extends upwardly and outwardly therefrom and terminates in a surrounding continuously configured peripheral edge 20. For reasons to be explained in greater detail hereinafter the peripheral edge has somewhat of an outwardly extending flange and has an under surface portion as at 22 which is cooperatively structured with a seat structure generally indicated as 24 for removable attachment and locking engagement therewith.

Figures 1, 2, 3:
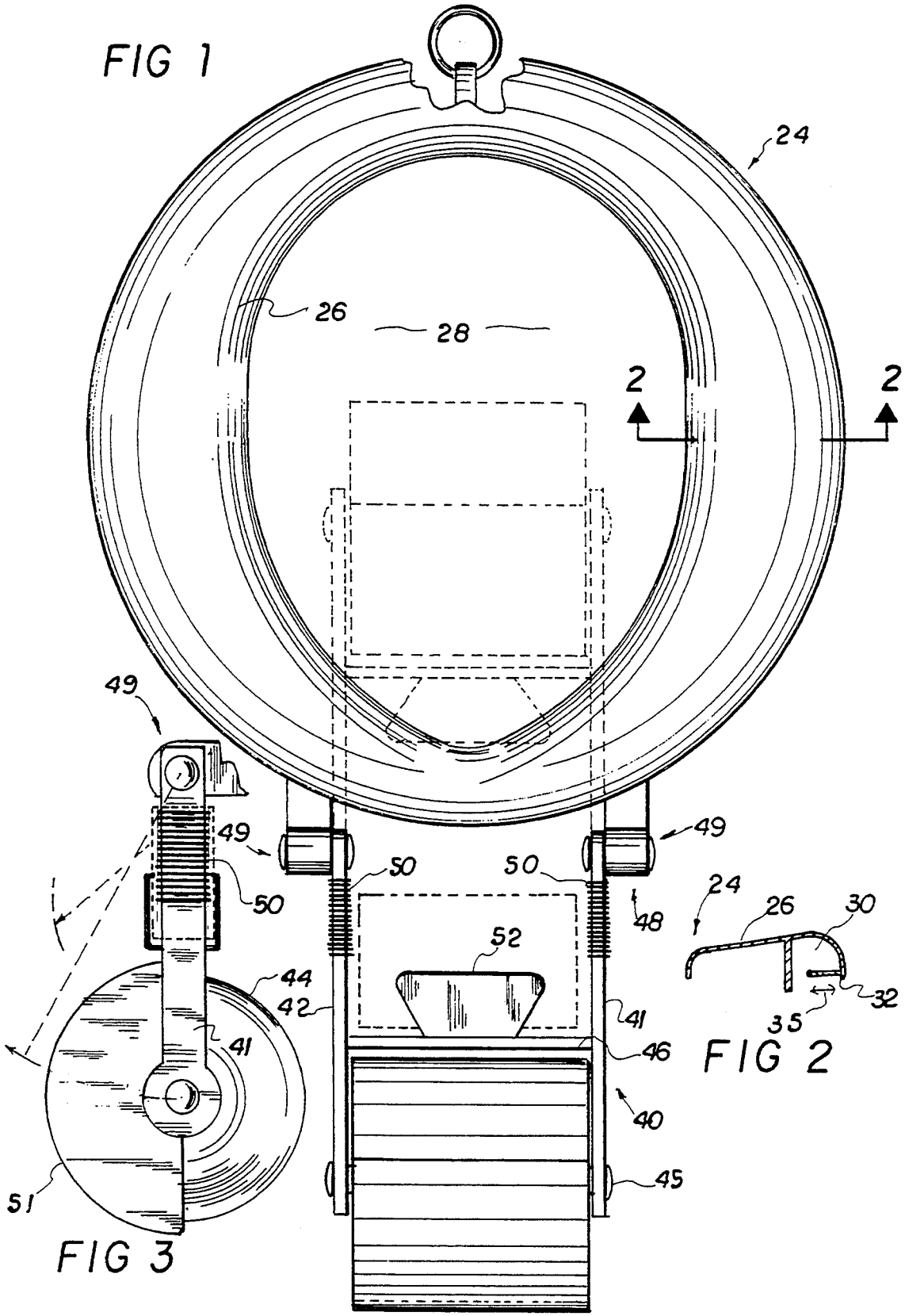
FIG. 1 is a top view in partial phantom of components of the subject toilet assembly.
FIG. 2 is a sectional view taken along line 2—2 of FIG. 1.
FIG. 3 is a side view in partial cut away of a portion of the embodiment of FIG. 1.
Figure 4:
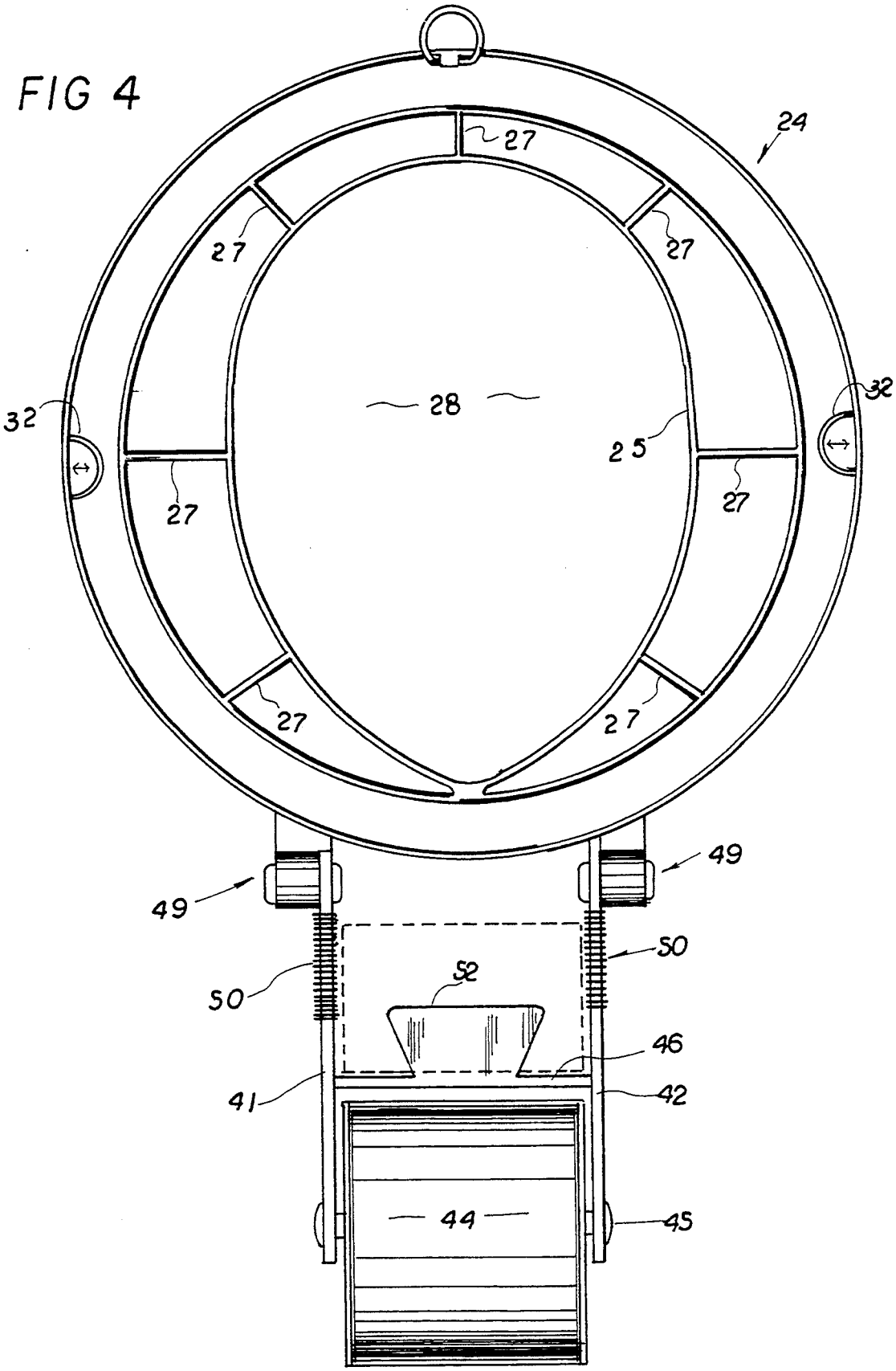
FIG. 4 is a bottom view of the embodiment of FIG. 1.
Figure 7:
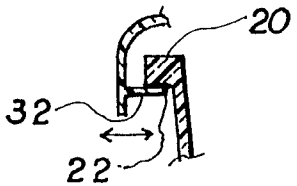
FIG. 7 is a sectional view in partial cut away of various components attached to one another of the present invention.

With primary reference to FIGS. 1 and 2 the seat structure 24 includes an upper or outer exposed surface 26 configured in dimension to facilitate comfortable seating thereon by occupant. A substantially central aperture as at 28 is formed in the seat structure as shown. As best shown in FIG. 4 the under surface of the seat structure 24 includes various structural reinforcement ribs 27 extending outwardly from a periphery of the central aperture 28. The reinforcement ribs 27 extend outwardly from the periphery 26 of the central channel 28. Such ribs terminate in an inner most peripheral edge or flange of a continuously formed substantially circular channel as at 30. The channel is specifically dimensioned, configured and otherwise adapted to receive therein, at least partially, the peripheral edge 20 of the container 12 in the matter shown both in FIGS. 2 and 7. More specifically, when the seat structure 24 is in its operative position, it rests on the peripheral edge 20 of the container 12 such that the central aperture 28 overlies and is in communication with the hollow container of the container 12. In order to secure a firm but removable locking engagement of the seat structure 24 with the peripheral edge 20 of the container 12, a locking means as best shown in FIG. 4 is provided. This locking means includes at least one but preferably a plurality of spaced apart locking members as at 32 located within the channel 30. Each of the locking members may take the form of somewhat of a spring like member having sufficient flexibility or resiliency such that it may move into and out of what may be referred to as a locking position again with reference to FIGS. 2 and 7, FIG. 2 shows the absence of any peripheral edge 20 of the container 12 therein. However, the flexibility of each of the locking members 32 or a portion of the seat structure to which it is attached is indicated such that movement occurs in accordance with the directional arrow 35. With reference to FIG. 7 the peripheral edge 70 is shaped such as to have an outwardly extending flange including the undersurface 22 to which the locking members 32 may engage in the position and orientation shown. When it is desired to remove the locking member the flexibility of not only the locking member but the seat structure itself is such that a portion of the seat structure may be expanded outwardly so as to remove the spaced apart locking members 32 from beneath the flange 20 and out of locking connection or engagement with the surface 22 thereof.

Another feature of the present invention is the provision of a paper dispenser generally indicated as 40. The dispenser 40 includes 2 outwardly extending parallel arms 41 and 42 disposed in sufficiently spaced apart relation to one another so as to accommodate a roll of paper 44 removably attached to a centrally disposed roller as 45. A brace member 46 serves to reinforce the arms. Mounting means generally indicated as 48 will serve to allow selective positioning of the arms 41 and 42 as well as the paper 44 into an outwardly extending substantially linearly oriented operative position shown in FIG. 1 or a downwardly extending substantially angularly oriented stored position shown in FIG. 3. The mounting means may include two spaced apart hinge mechanisms generally indicated as 49 attached to the inner most ends of each of the arms 41 and 42. The hinge mechanisms are cooperatively adapted to be utilized in combination with the binding or locking springs as at 50 such that the hinges will be selectively maintained in either the operative position of FIG. 1 or the stored position of FIG. 3 due to the pressure exerted on the hinge by the inwardly directed and normally biased springs 50, thus minimizing unwanted movement of the hinge due to the need to compress the spring during pivotal movement. A removable cover or lid type structure as at 51 may be utilized to overlie a front or exposed portion of the paper roll served to protect against dampness whether the paper dispenser 40 is in its operative or stored position. A handle as at 52 may be utilized to accomplish the above noted selected positioning.

As shown primarily in FIG. 6, another feature of the present invention includes a cleansing assembly generally indicated as 60. The cleansing assembly includes a supply container as at 62 of a cleansing fluid which may be water or other applicable liquid 64. An applicator as at 66 is disposed beneath the seat structure 24 and at least partially on the interior of the container such that the liquid may be directed through the aperture 28 onto an appropriate portion of the occupant of the seat structure 24. A pump means generally indicated at 68 may be operated by the foot or other portions of the users body. When manual force is applied thereto the liquid 64 is forced or driven through appropriate conduits as at 69 from the container 62 throughout the conduits 69 past and through the pump 68 and to the applicator 66 for delivery to the occupant as setforth above.

Proper brackets or attachments means as at 70 may be utilized to removably secure the container 62 to the exterior portion of the side walls 18 of the container 12.

Figure 5:
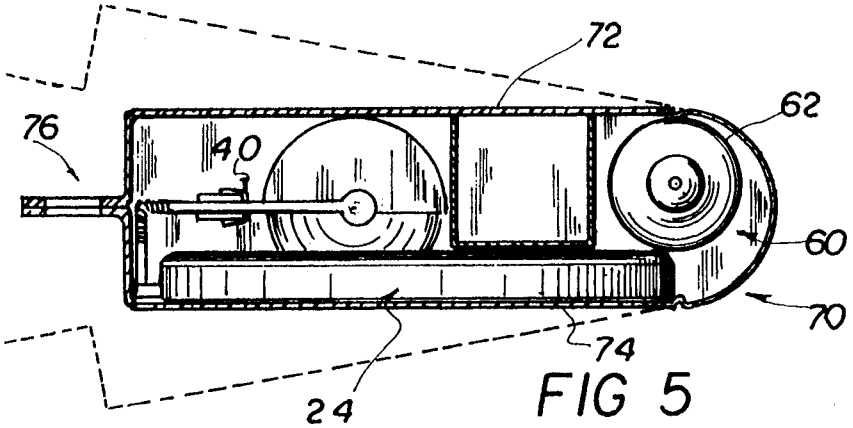
FIG. 5 is a longitudinal sectional view in partial phantom.
Figure 8:
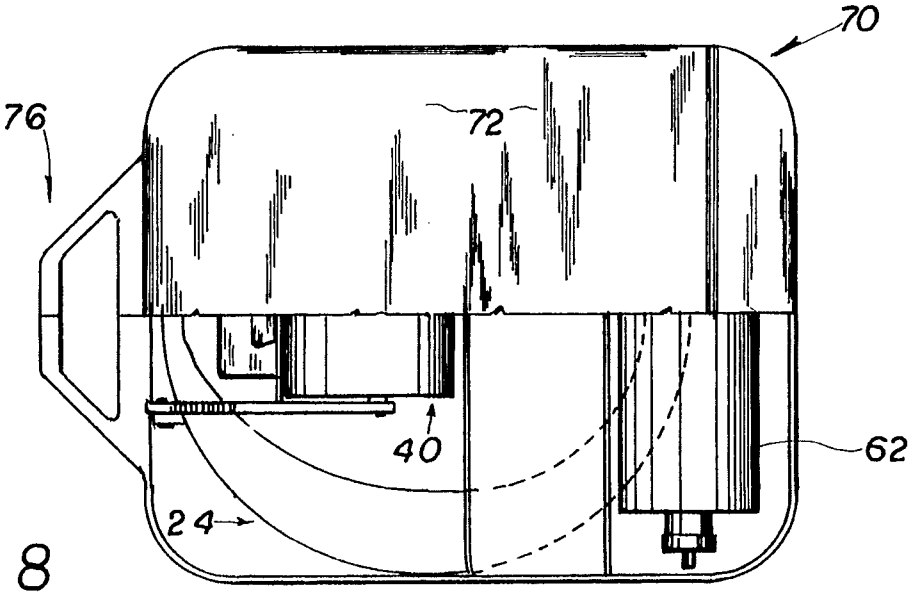
FIG. 8 is a top view in partial cut away of the embodiment of FIG. 5.

Yet another feature of the present invention is the inclusion of a carrying case as at 70 including side wall portions 72 and 74. The carrying case is at least partially hollow and has certain compartment areas to facilitate storage and carrying of the seat structure 24, the paper dispensing assembly 40, and the cleansing assembly 62, generally disposed in the manner shown in FIG. 5. A handle as at 76 is connected to the respective side wall portions 72 and 74 and may be used to carry the case when it is in its closed position as shown in some of the lines in FIG. 5.

Now that the invention has been described:

What is claimed is:

1. A portable toilet assembly comprising:

a) a container having a hollow interior and including a closed bottom end and a continuous, cylindrical side wall connected thereto and extending outwardly therefrom, said side wall terminating in a substantially continuous peripheral edge adapted to define a periphery of an open end oppositely disposed relative to said closed end, b) a seat structure having a central opening and being removably mounted on said container in overlying relation to said open end and in communication with said hollow interior, c) said seat structure including an outer surface configured to have a person sit thereon and an under surface adapted to be removably connected to said peripheral edge, d) locking means mounted on said under surface and adapted for removably locking engagement with a portion of said peripheral edge, e) a paper dispensing means connected to said seat structure and selectively positionable into an operative, accessible location relative to an occupant of said seat structure, f) mounting means adapted for movably connecting said paper dispenser to said seat structure, and g) said paper dispenser being selectively positionable between an operative position and a stored position, said operative position being defined by a substantially outwardly extending linear orientation relative to said seat structure and said stored position being defined by downward, angled orientation relative to said operative position and said seat structure.

2. An assembly as in claim 1 further comprising a cleansing assembly including a supply of cleansing liquid and a pump structure and an applicator, said applicator disposed at least in part within said hollow interior of said container and beneath said seat structure; conduit means interconnecting said liquid supply, pump structure and applicator and adapted for establishing fluid communication therebetween, said pump structure adapted to force liquid from said liquid supply through said conduit means to said applicator and onto a person sitting on said seat structure through said central opening thereof.

3. An assembly as in claim 2 further comprising a casing structurally adapted to have said cleansing assembly and a paper dispenser adapted to be removably attachable to said seat structure mounted therein.

4. An assembly as in claim 1 wherein said locking means comprises at least one locking member having a resilient construction and selectively positionable into and out of locking engagement with said peripheral edge.

5. An assembly as in claim 4 wherein said locking means comprises a plurality of locking members each disposed in spaced apart relation to one another and having a resilient construction and being selectively positionable into and out of locking engagement with said peripheral edge.

6. An assembly as in claim 1 wherein said paper dispenser comprises to spaced apart, substantially parallel arms and a holder member removably extending therebetween and adapted to support a paper roll between said arms.

7. An assembly as in claim 6 wherein said mounting means comprises a hinge assembly connected to an inner end of each of said arms and adapted to allow pivotable movement of said arms between an outwardly extending, substantially linear orientation and a depending, angled orientation.

8. An assembly as in claim 1 wherein said under surface comprises a continuously configured channel adapted to removably receive said peripheral edge therein; said locking means mounted within said channel.

9. An assembly as in claim 8 wherein said locking means comprises at least one locking member mounted within said channel and having a resilient construction and being selectively positionable into and out of locking engagement with said peripheral edge.

10. An assembly as in claim 9 wherein said locking means comprises a plurality of locking members each mounted within said channel and disposed in spaced relation to one another and each having a resilient construction and being selectively positionable into and out of locking engagement with said peripheral edge.

11. A portable toilet assembly comprising:

a) a container having a hollow interior and including a closed bottom end and a continuous, cylindrical side wall connected thereto and extending outwardly therefrom, b) said side wall terminating in a substantially continuous peripheral edge adapted to define a periphery of an open end oppositely disposed relative to said closed end, c) a seat structure having a central opening and being removably mounted on said container in overlying relation to said open end and in communication with said hollow interior, d) said seat structure including an outer surface configured to have a person sit thereon and an under surface adapted to be removably connected to said peripheral edge, e) a paper dispensing means connected to said seat structure and selectively positionable into an operative, accessible location relative to an occupant of said seat structure, f) mounting means adapted for movably connecting said paper dispenser to said seat structure, and g) said paper dispenser being selectively positionable between an operative position and a stored position, said operative position being defined by a substantially outwardly extending orientation relative to said seat structure and said stored position being defined by a downward, angled orientation relative to said operative position and said seat structure.

12. An assembly as in claim 11 further comprising a cleansing assembly including a supply of cleansing liquid, a pump structure and an applicator, said applicator disposed at least partially within said hollow interior of said container and beneath said seat structure; conduit means adapted for establishing fluid communication between said liquid supply and said applicator and interconnecting said liquid supply, said pump structure and said applicator; said pump structure adapted to force liquid from said liquid supply through said conduit means to said applicator and onto a person sitting on said seat structure.

* * * * *